US011021928B2

(12) United States Patent
Patsy et al.

(10) Patent No.: US 11,021,928 B2
(45) Date of Patent: Jun. 1, 2021

(54) SETTING ADAPTER ASSEMBLY FOR PLUG

(71) Applicant: CNPC USA CORPORATION, Houston, TX (US)

(72) Inventors: Matthew Patsy, Houston, TX (US); Damon Nettles, Houston, TX (US)

(73) Assignee: CNPC USA CORPORATION, Houston, TX (US)

( * ) Notice: Subject to any disclaimer, the term of this patent is extended or adjusted under 35 U.S.C. 154(b) by 0 days.

(21) Appl. No.: 16/654,821

(22) Filed: Oct. 16, 2019

(65) Prior Publication Data

US 2020/0115990 A1 Apr. 16, 2020

Related U.S. Application Data

(60) Provisional application No. 62/746,346, filed on Oct. 16, 2018.

(51) Int. Cl.
*E21B 33/129* (2006.01)
*E21B 33/128* (2006.01)

(52) U.S. Cl.
CPC ..... *E21B 33/1291* (2013.01); *E21B 33/128* (2013.01)

(58) Field of Classification Search
CPC ... E21B 33/128; E21B 33/1291; E21B 33/134
See application file for complete search history.

(56) References Cited

U.S. PATENT DOCUMENTS 1,382,770 A * 6/1921 Fondren ..... E21B 33/128 277/338
2,017,434 A * 10/1935 Church ..... E21B 23/06 166/124
3,642,064 A * 2/1972 Rosenthal ..... E21B 33/134 166/134
2019/0186223 A1* 6/2019 Mhaskar ..... E21B 33/12

* cited by examiner

*Primary Examiner* — D. Andrews
(74) *Attorney, Agent, or Firm* — Craft Chu PLLC; Andrew W. Chu

(57) ABSTRACT

A setting adapter assembly for setting a plug is provided, it comprises a setting body, a crossover sub, a shear ring connecting the setting body and the crossover sub temporarily, a rotating dog carrier at a lower end of the setting body, a plurality of rotating dogs accommodated in the rotating dog carrier; an inner mandrel, The rotating dogs are in their vertical position to compress the plug during a process of setting the plug, and during a process of withdrawing, the rotating dogs rotate 90 degrees into their horizontal position driven by the inner mandrel to allow the setting adapter assembly pass through the plug.

11 Claims, 10 Drawing Sheets

SETTING ADAPTER ASSEMBLY FOR PLUG

CROSS-REFERENCE TO RELATED APPLICATIONS

This present application claims priority under 35 U.S.C. Sections 119(e) from U.S. Provisional Patent Application Ser. No. 62/746,346, filed on Oct. 16, 2018, entitled "Setting Adapter Assembly for Plug".

FIELD

The disclosure relates generally to subsurface well apparatus. The disclosure relates specifically to apparatus for setting packers, such as plugs.

BACKGROUND

In the drilling, completing of oil wells, it is often necessary to isolate particular zones within the wall. In some applications, downhole tools, known as bridge plugs, fracture ('frac') plugs, and the like, are inserted into the well to isolate zones. The purpose of the bridge plug or frac plug is to isolate some portion of the well from another portion of the well. For example, perforation in the well in one portion may need to be isolated from perforations in another portion of the well, or there may be a need to isolate the bottom of the well from the wellhead. Accordingly, the plug may experience a high differential pressure, and must be capable of withstanding the pressure so that the plug seals the well, and does not move in the well after being set.

A plug is generally comprised of one or two slips and cones as well as an elastomeric packing element arranged about a mandrel that is run into the wellbore. The slip may be initially formed in a ring, designed to break apart upon the application of an axial force. The slip includes a tapered surface that is adapted to mate with a tapered surface of the cone. As an axial force is applied to the plug, relative movement between the slip and the cone happens, the slip moves up on the tapered surface of the cone and breaks apart to form a number of individual slip elements, and the slip elements are driven outwardly, away from the mandrel, and thus engages the casing wall, locking the slip in place within the casing. Further application of axial force compresses the elastomeric packing element, driving the packing element outwardly to contact and seal against the wellbore. The axial compression of the packing element causes the packing element to expand radially against the well casing creating a sealing barrier that isolate a portion of the well.

When it is desired to remove one or more of these plugs from a wellbore, it is often simpler and less expensive to mill or drill them out rather than to implement a complex retrieving operation. In milling, a milling cutter is used to grind the plug. In drilling, a drilling bit is used to cut and grind up the components of the plug to remove it from the wellbore. the milling or drilling operations may be slowed because of the materials of the packer or bridge plug employed. For example, these downhole tools are frequently formed including metallic components, such as hardened iron or steel, which are difficult, or require specialized tools and techniques, to mill or drill.

The process and apparatus required for setting a plug in a well have been more complicated, expensive and time consuming than is desirable. Setting of a plug is normally performed by slickline, braided line, wireline or coiled tubing. Setting devices usually need for a bottom cap and shear pins to help applying pressure on the plug such that the plug can be locked in the well. Furthermore, one difficulty associated with setting a plug is that the setting device is de-coupled form the plug after the plug has been completely and successfully deployed. The setting device usually provide shear pins to connect the plug, after setting the plug, pulling the setting device outward to shear the pin to disconnect the plug, in this case, the plug will endure tensile forces to keep locking on the wall of the well. In order to endure the tensile forces and to avoid the rupture of the plug when the setting device is de-coupling form the plug, the wall of the plug body need a certain thickness to have sufficient strength. Therefore, the inner diameter of the plug will decrease, the milling or drilling operations may be slowed because of the thick wall of the plug.

Therefore, it would be advantageous to provide improved setting device of novel construction which is simple, and capable of rapid and efficient operation.

SUMMARY

The present invention is directed to a method and system for setting a plug at a desired location in the wellbore. The novel construction of the system leads the setting of plug simple, inexpensive and dependable and capable of rapid and efficient operation.

In one aspect, the invention is directed to a setting adapter assembly for setting a plug, comprises a setting body, a crossover sub, a shear ring connecting the setting body and the crossover sub temporarily, a rotating dog carrier at a lower end of the setting body, a plurality of rotating dogs accommodated in the rotating dog carrier; an inner mandrel fixedly connecting with the crossover sub and extends through the shear ring, the setting body and coming into an inner chamber of the rotating dog carrier. wherein the rotating dogs are arranged at the bottom of the plug and in their vertical position to compress the plug during a process of setting the plug, and during a process of withdrawing the setting adapter assembly, the rotating dogs rotate 90 degrees into their horizontal position driven by the movement of the inner mandrel to allow the setting adapter assembly pass through the plug.

In one embodiment, the rotating dog carrier comprises a plurality of dog carrier subs to accommodate corresponding rotating dogs. Each of the rotating dogs comprising a setting tab and a pivot pin. The dog carrier subs comprising slots to accommodate the pivot pins.

In some embodiments pertain to the inner mandrel, the inner mandrel comprises a pocket to accommodate a portion of the setting tabs when the rotating dogs are in their vertical position. setting tab comprising a ramped face, the inner mandrel comprising a bottom end being adjacent the pocket, the bottom end comprising a ramped leading edge face for engaging ramped face of the setting tab.

In some embodiments, the setting adapter assembly further comprising a travel restriction mechanism to limit the distance that the inner mandrel can move in the setting body. the travel restriction mechanism comprising a locking ring and a circumferential groove. The locking ring is embedded in a slot in the inner surface of the setting body and is located adjacent a bottom end of the shear ring. The length of the circumferential groove is configured to allow the inner mandrel to move from initial position to the position that the bottom end abuts the setting tab to keep the rotating dogs in their horizontal position.

In another aspect, the invention is directed to a method for setting a plug, the method comprises the step of, arranging the setting adapter assembly between the plug and a setting tool; the setting adapter assembly comprising: a setting body; a crossover sub; a shear ring connecting the setting body and the crossover sub temporarily; a rotating dog carrier at a lower end of the setting body; a plurality of rotating dogs accommodated in the rotating dog carrier; an inner mandrel fixedly connecting with the crossover sub and extends through the shear ring, the setting body and coming into an inner chamber of the rotating dog carrier; wherein the rotating dogs are arranged at the bottom of the plug and in their vertical position to compress the plug during a process of setting the plug, and during a process of withdrawing the setting adapter assembly, the rotating dogs rotate 90 degrees into their horizontal position driven by the movement of the inner mandrel to allow the setting adapter assembly pass through the plug. running the setting tool loaded with the plug and the setting adapter assembly into the downhole; at a desired location, pushing a plug body of the plug downwardly with a first force while keeping the crossover sub staying still to set the plug; pushing the plug body of the plug downwardly with a second force to shear the shear ring; withdrawing the setting adapter assembly through the plug.

This setting adapter assembly simplifies the design of a plug by removing the need for a bottom cap and shear pins.

The setting adapter assembly also sets the frac plug from the bottom. This eliminates any tensile forces in the plug body. The elimination of tensile forces in the plug body allows the plug body to be thinner, thus allowing the plug inner diameter to be larger. This makes the plug smaller, cheaper and less complicated.

The foregoing has outlined rather broadly the features of the present disclosure in order that the detailed description that follows may be better understood. Additional features and advantages of the disclosure will be described hereinafter, which form the subject of the claims.

BRIEF DESCRIPTION OF THE DRAWINGS

In order that the manner in which the above-recited and other enhancements and objects of the disclosure are obtained, a more particular description of the disclosure briefly described above will be rendered by reference to specific embodiments thereof which are illustrated in the appended drawings. Understanding that these drawings depict only typical embodiments of the disclosure and are therefore not to be considered limiting of its scope, the disclosure will be described with additional specificity and detail through the use of the accompanying drawings in which.

Like elements in the various figures are denoted by like reference numerals for consistence.

DETAILED DESCRIPTION

The particulars shown herein are by way of example and for purposes of illustrative discussion of the preferred embodiments of the present disclosure only and are presented in the cause of providing what is believed to be the most useful and readily understood description of the principles and conceptual aspects of various embodiments of the disclosure. In this regard, no attempt is made to show structural details of the disclosure in more detail than is necessary for the fundamental understanding of the disclosure, the description taken with the drawings making apparent to those skilled in the art how the several forms of the disclosure may be embodied in practice.

The following definitions and explanations are meant and intended to be controlling in any future construction unless clearly and unambiguously modified in the following examples or when application of the meaning renders any construction meaningless or essentially meaningless. In cases where the construction of the term would render it meaningless or essentially meaningless, the definition should be taken from Webster's Dictionary 3$^{rd}$ Edition.

As used herein, the terms "up" and "down"; "upper" and "lower"; "upwardly" and downwardly"; "above" and "below"; and other like terms as used herein refer to relative positions to one another and are not intended to denote a particular direction or spatial orientation. the terms "radial" and "radially" include directions inward toward (or outward away from) the center axial direction of the item of oilfield equipment but not limited to directions perpendicular to such axial direction or running directly through the center.

The present application discloses a setting adapter assembly used in setting a plug in a well, more specifically, the setting adapter assembly is used in the setting process of a wireline set frac plug and is initially made up between a frac plug and a wireline setting tool. It sets the plug from the bottom, which eliminates any tensile forces in the plug body. The elimination of tensile forces in the plug body allows the plug body to be thinner, thus allowing the plug inner diameter to be larger.

Figure 1:
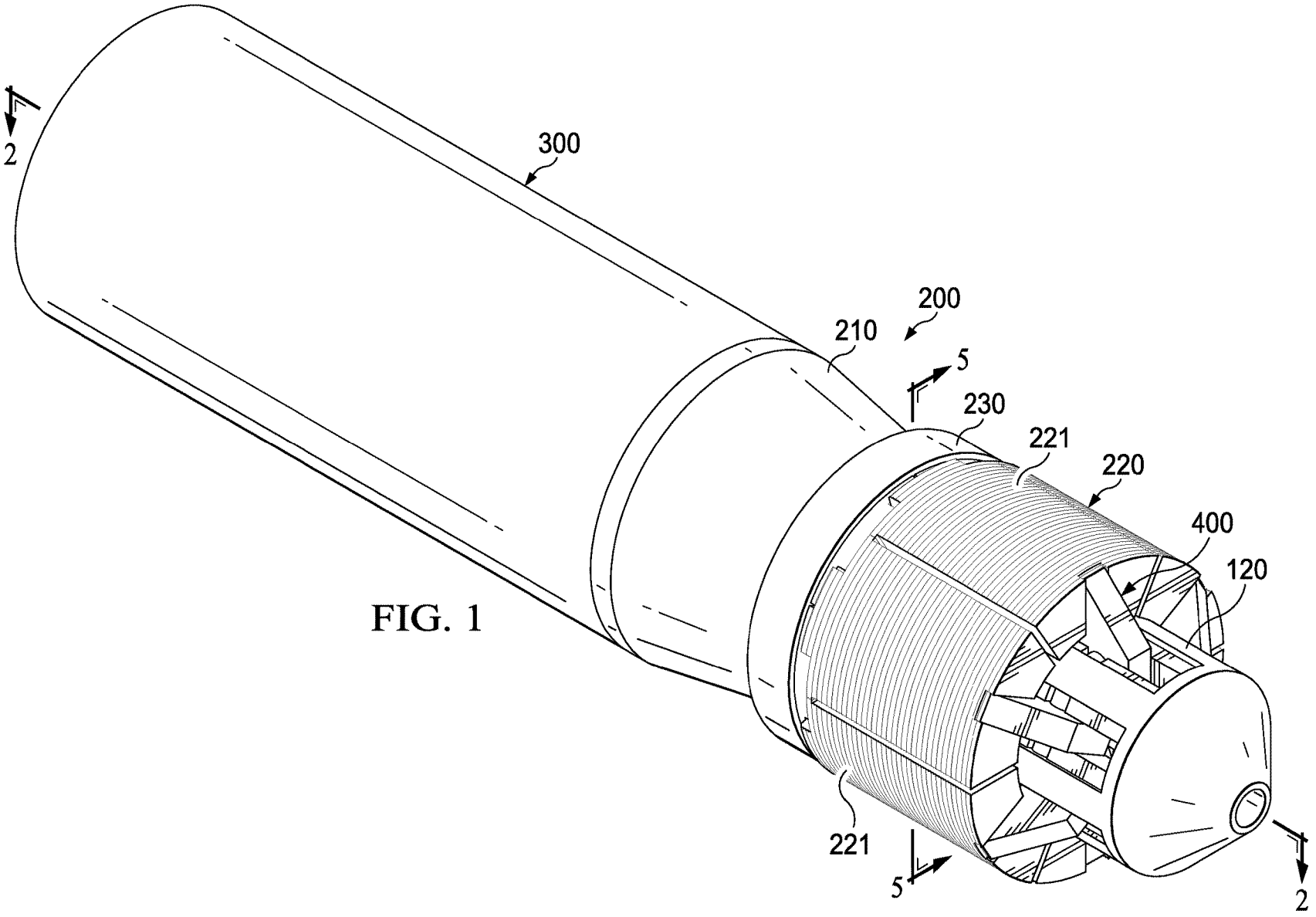
FIG. 1 is a perspective view of a plug coupled to a setting adapter assembly in accordance with an embodiment of the present invention.
Figure 2:
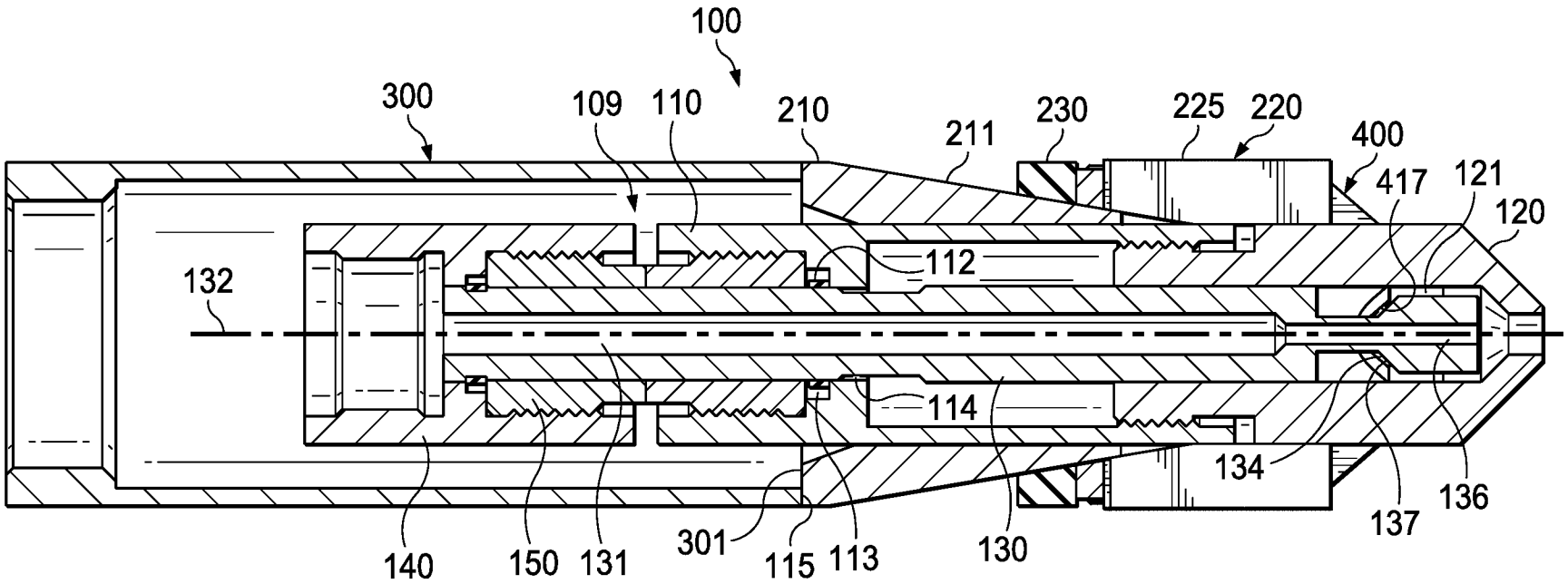
FIG. 2 is a cross-sectional view of FIG. 1.

Referring to FIGS. 1 and 2, an embodiment of the plug 200 and the setting adapter assembly disclosed herein is illustrated. The plug is coupled to the setting adapter assembly before being run into the wellbore, which allows the setting portions to be engaged at the surface. The setting adapter assembly 100 comprises a centrally located, elongated tubular setting body 110 of substantially uniform external diameter throughout its length and closed and terminating at its lower end by a rotating dog carrier 120. The upper end of the body 110 is temporarily connected to a crossover sub 140 by a shear ring 150. The crossover sub 140 is fixedly connected with a wireline setting tool (not shown).

The plug 200 includes a plug body 210 and a plug slip 220 disposed around the setting body 110, intermediate the plug body 210 and the plug slip 220 is a plug seal 230. The plug body 210 has a sloped outer surface 211, such that when assembled on the setting body 110, the outer diameter of the plug body 210 decreases in an axial direction toward the plug slip 220. The slip 220 is disposed below the plug body 210 and has a sloped inner surface 223 (referring to FIG. 3)

adapt to rest on a complementary sloped outer surface 211 of the plug body 210. As explained in more detail below, the slip 220 travel about the surface 211 the plug body 210, thus expanding radially outward from the setting body 110 to engage an inner surface of a casing wall.

The slip 220 can include a plurality of slip segments 221 to engage an inner surface of a surrounding casing wall, as the slip 220 move radially outward from the setting body 110 due to the axial movement across the plug body 210. Each of the slip segments 221 can be configured to be displaceable radically to secure the plug 200 in the well casing. The slip segments 221 can have a plurality of raised ridges 225, which can be sized and shaped to bite into the casing wall. Thus, when an outward radial force is exerted on the slip, the plug body 210 can break the slip 220 into the separable slip segments 221 that can bite into the casing wall and wedge between the plug 200 and the casing wall. In this way, the slip segments 221 can secure the plug in a desired location in the casing.

The slip 220 can be formed of a material that is easily drilled or machined so as to facilitate easy removal of the plug 220 from a casing. For example, the slip 220 can be formed of a cast iron or composite material.

Figure 3:
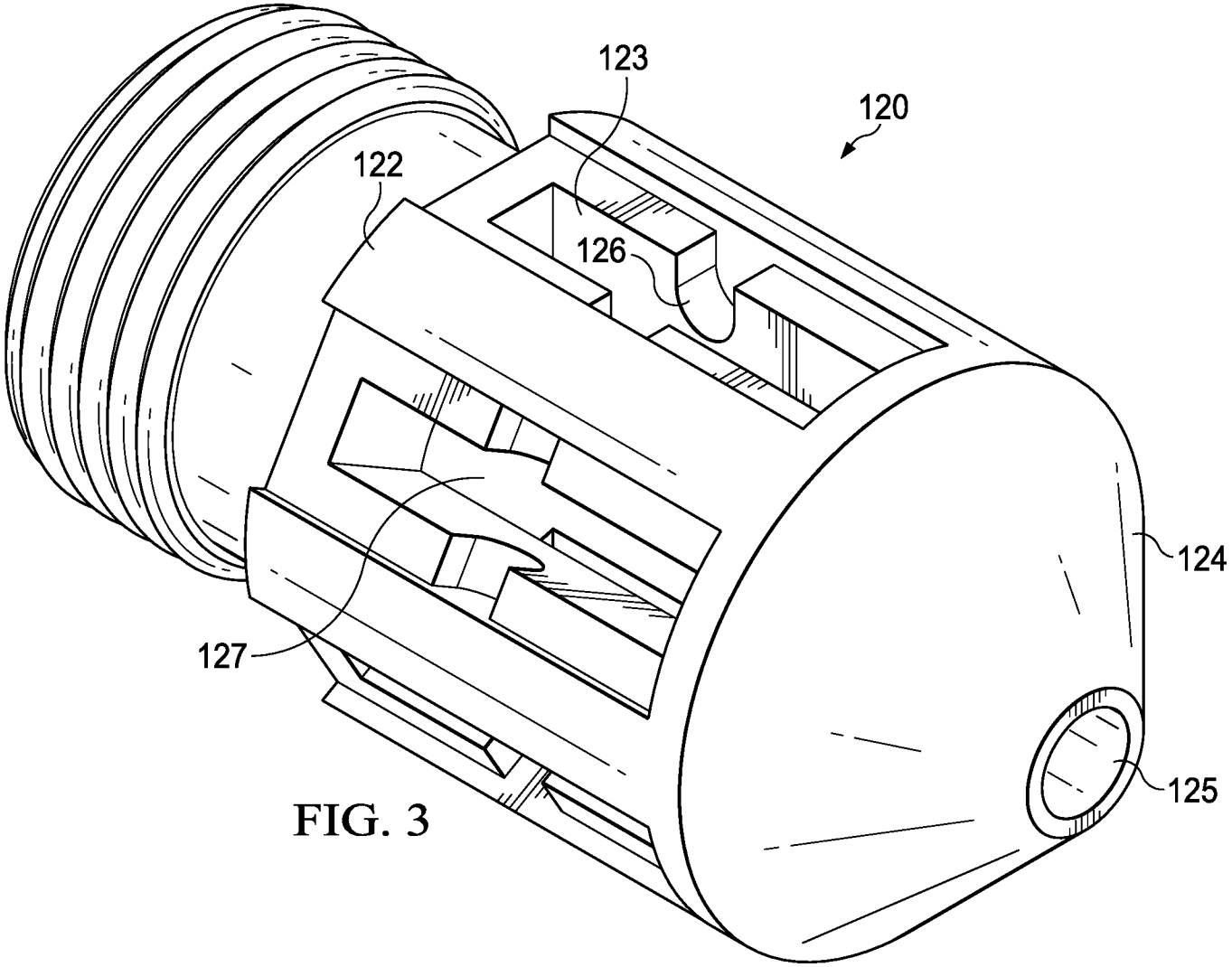
FIG. 3 is a perspective view of a rotating dog carrier.

Referring to FIGS. 1 to 3, a plug seal 230 is disposed around the plug body 210, the a plug seal 230 can have an outer diameter just slightly smaller than the diameter of a well casing (not shown) and can be compressible alone the longitudinal axis of the plug body 210 and radially expandable in order to form a seal between the plug body 210 and the casing wall in a wellbore. the plug seal 230 is a sealing element that prevent fluid from communicating between the upper and lower zone when a pressure differential is applied to the plug 200. It may be formed from any material capable of expanding and sealing an annulus within the casing. and is preferably constructed of one or more synthetic materials capable of withstanding high temperatures and pressures, for example, elastomers, rubbers, blends and combinations thereof.

The upper end face of the plug body 210 contacts the lower end of a setting sleeve 300 of a wireline setting tool (not shown). The crossover sub 140 is accommodated in the setting sleeve 300, the upper end of setting body 110 is surrounded by the setting sleeve 300 and the lower end of setting body 110 is surrounded by the frag 200, thus the setting sleeve 300 and the frag 200 can freely slide alone setting body 110.

The rotating dog carrier 120 is fixedly connected with the setting body 110. The setting body 110 and the rotating dog carrier 120 are hollow structures, an inner mandrel 130 is fixedly connected with the crossover sub 140 and extends through the shear ring 150, the setting body 110 and comes into the inner chamber 121 of the rotating dog carrier 120. The inner mandrel 130 has a thorough channel, or path 131 along its central axis to allow fluid flow through thereof. Referring to FIG. 3, the bottom end of the rotating dog carrier 120 is a cone shaped member 124, a thorough hole 125 is at the conical top to allow the fluid flow out of the setting adapter assembly 100.

Figure 4:
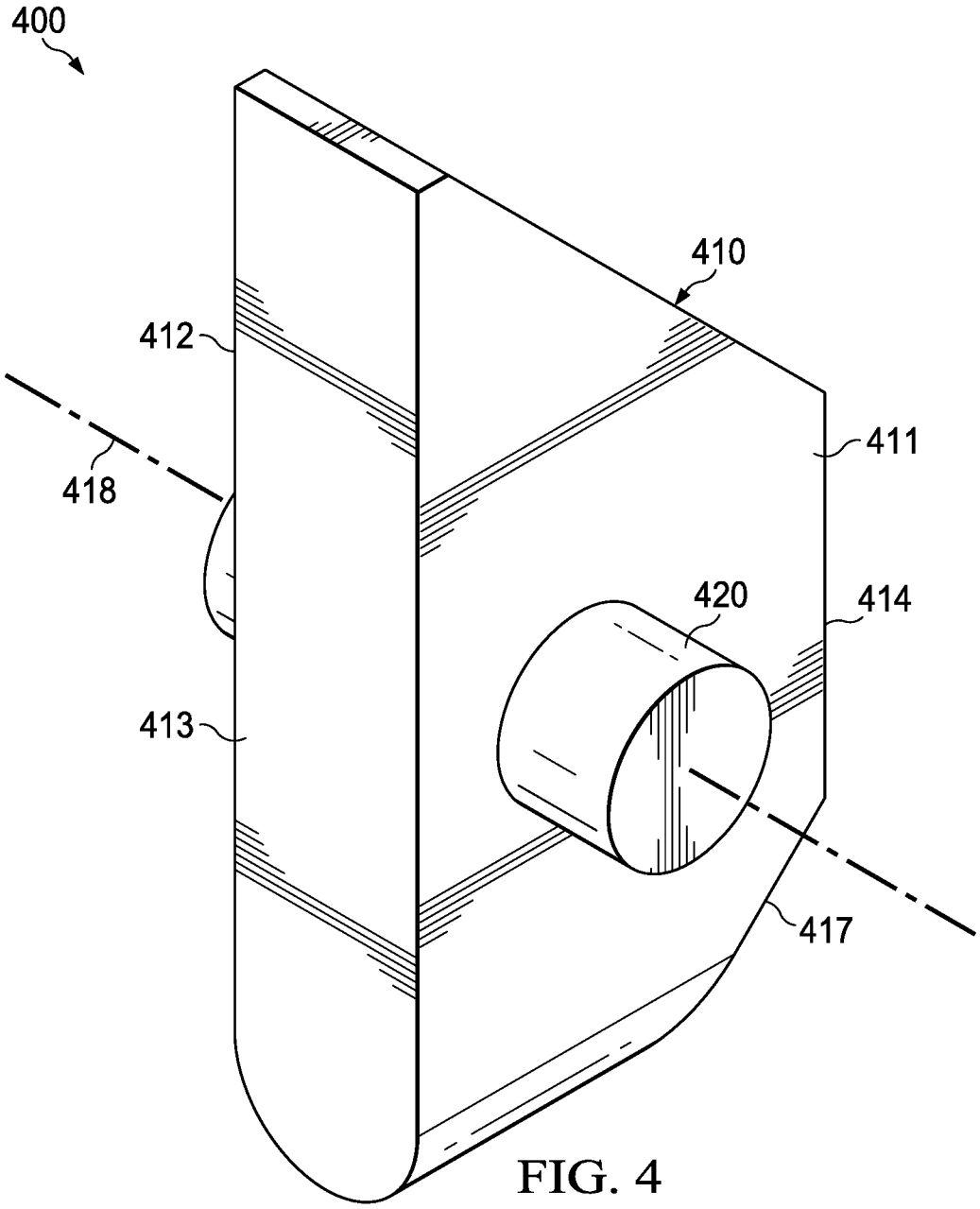
FIG. 4 is a perspective view of a rotating dog.

A plurality of thorough slots form dog carrier subs 123 along the circumference of the side wall 122 of the rotating dog carrier 120. The dog carrier subs 123 are used to accommodate corresponding rotating dogs 400 configured to hold the slip 220 during the process of setting the plug 200 as described in greater detail further below. Referring to FIG. 4, each of the rotating dogs 400 comprise a setting tab 410 and a pivot pin 420 which can be configured to define an axis about which the setting tab 410 can be rotated. the setting tab 410 has two sidewalls 411,412 which are perpendicular, or at least substantially perpendicular, to the pivot pin 420. In one embodiment, the setting tab 410 comprise two parallel, or at least substantially parallel planes 413, 414, the two planes 413, 414 are further parallel, or at least substantially parallel to pivot pin 420, wherein the plane 413 is longer than the plane 414, such that the shapes of the two sidewalls 411,412 are trapezoids or substantial trapezoids.

The dog carrier subs 123 have slots 126 to accommodate the pivot pin 420 of the rotating dog 400, The dog carrier subs 123 is configured that the setting tab 410 can be freely rotated around the pivot pin 420 clockwise from the position where the parallel planes 413, 414 are perpendicular to the axis of the inner mandrel 130 to the position where the parallel planes 413, 414 are parallel to the axis of the inner mandrel 130, and when the parallel planes 413, 414 is parallel to the axis of the inner mandrel 130, the parallel plane 413 is flush with the outer side surface of the rotating dog carrier 120.

The inner mandrel 130 also provides a pocket 134 which is configured to accommodate a portion of the setting tab 410 when the setting tab 410 is located in the dog carrier subs 123 and the parallel planes 413, 414 are perpendicular to the axis of the inner mandrel 130. The setting tab 410 has a tapered or ramped face 417, the ramped face 417 is configured as such, when the parallel planes 413, 414 are perpendicular to the axis of the inner mandrel 130, the sectional area of the setting tab 410 gradually increases from the center axis of the rotating dog carrier 120 to circumference of the side wall 122 of the rotating dog carrier 120.

The bottom end 136 of the inner mandrel 130 is adjacent the pocket 134, it has a tapered or ramped leading edge face 137 for engaging ramped face 417 of the setting tab 410. Therefore, if the inner mandrel 130 moves upward, the bottom end 136 will drive the setting tab 410 rotate around the pivot pin 420 clockwise from the position where the parallel planes 413, 414 are perpendicular to the axis of the inner mandrel 130 to the position where the parallel planes 413, 414 are parallel to the axis of the inner mandrel 130. The setting tab 410 is configured that the parallel plane 414 is flush with the inter side surface of the rotating dog carrier 120 when the parallel planes 413, 414 is parallel to the axis of the inner mandrel 130.

Figure 5:
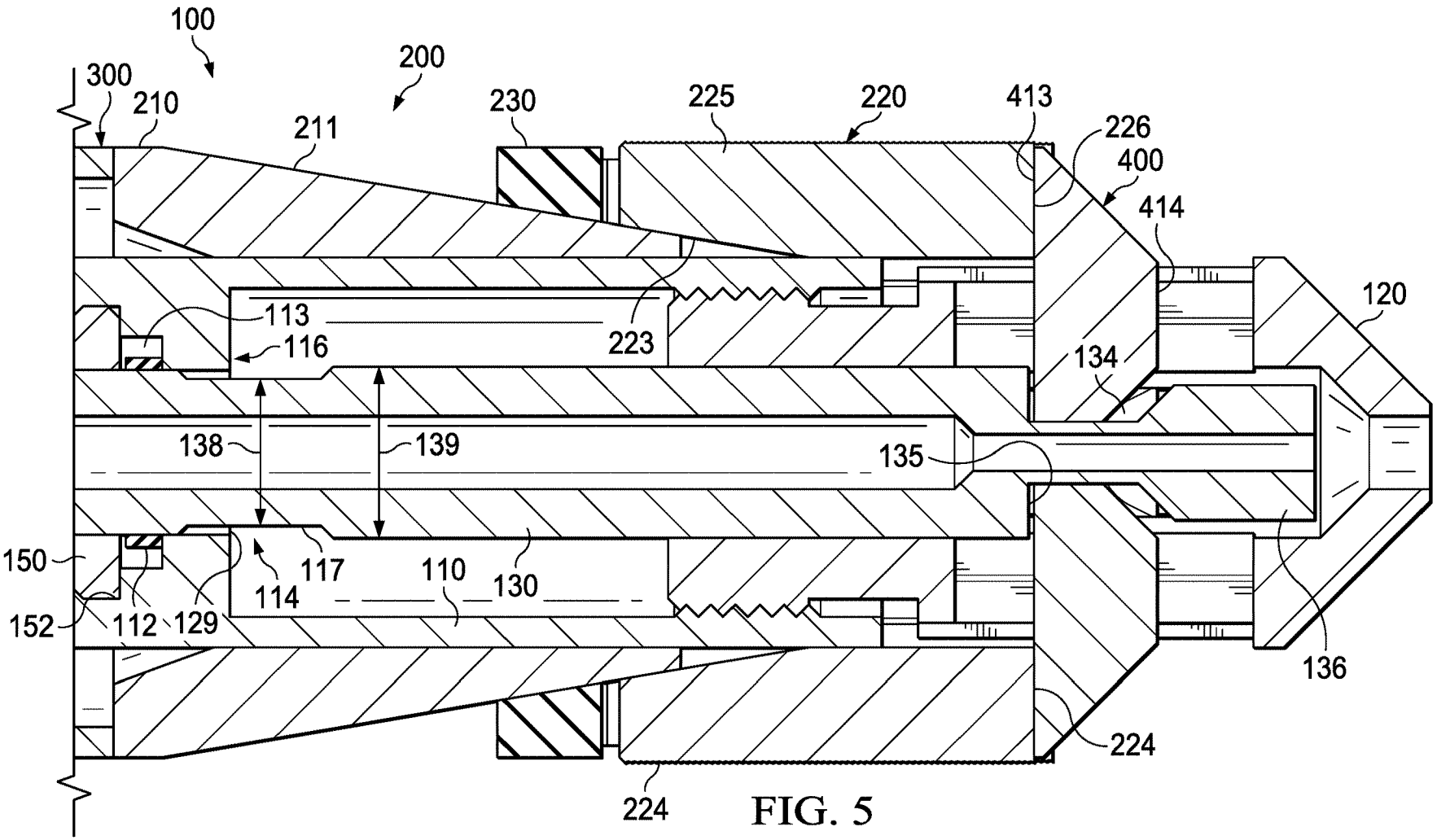
FIG. 5 is a cross-sectional view of a plug and setting adapter assembly, wherein the plug is in the "Run in Hole" position.

Now referring to FIG. 5, the plug 200 is coupled to the setting adapter assembly 100 before being run into the wellbore. The rotating dogs 400 are initially in their vertical positions. The pivot pin 420 of each of the rotating dogs 400 is in the slots 126. The parallel plane 413 is extended form the outer circumference of the plug slip 220 to the outer circumference of the pocket 134 and appress the bottom end surface of the plug slip 220. The parallel plane 413 further contact the top surface of the pocket 134 such that the setting tab 410 cannot rotate clockwise. the setting tab 410 cannot rotate counterclockwise either because it is blocked by the bottom end 136 of the inner mandrel 130. In this case, the plug 200 is sandwiched in between the setting sleeve 300 and the rotating dogs 400. In an embodiment, the rotating dogs 400 distribute evenly along the circumference of the rotating dog carrier 120. In a preferred embodiment, the number of the rotating dogs 400 is equal to that of the slip segments 221 of the plug slip 220, and each of the setting tab 410 is against a corresponding slip segment 221 to ensure the force evenly. A setting tool (not shown) is run into a downhole in this assembled state, until the plug 200 reaches the desired position.

Figure 6:
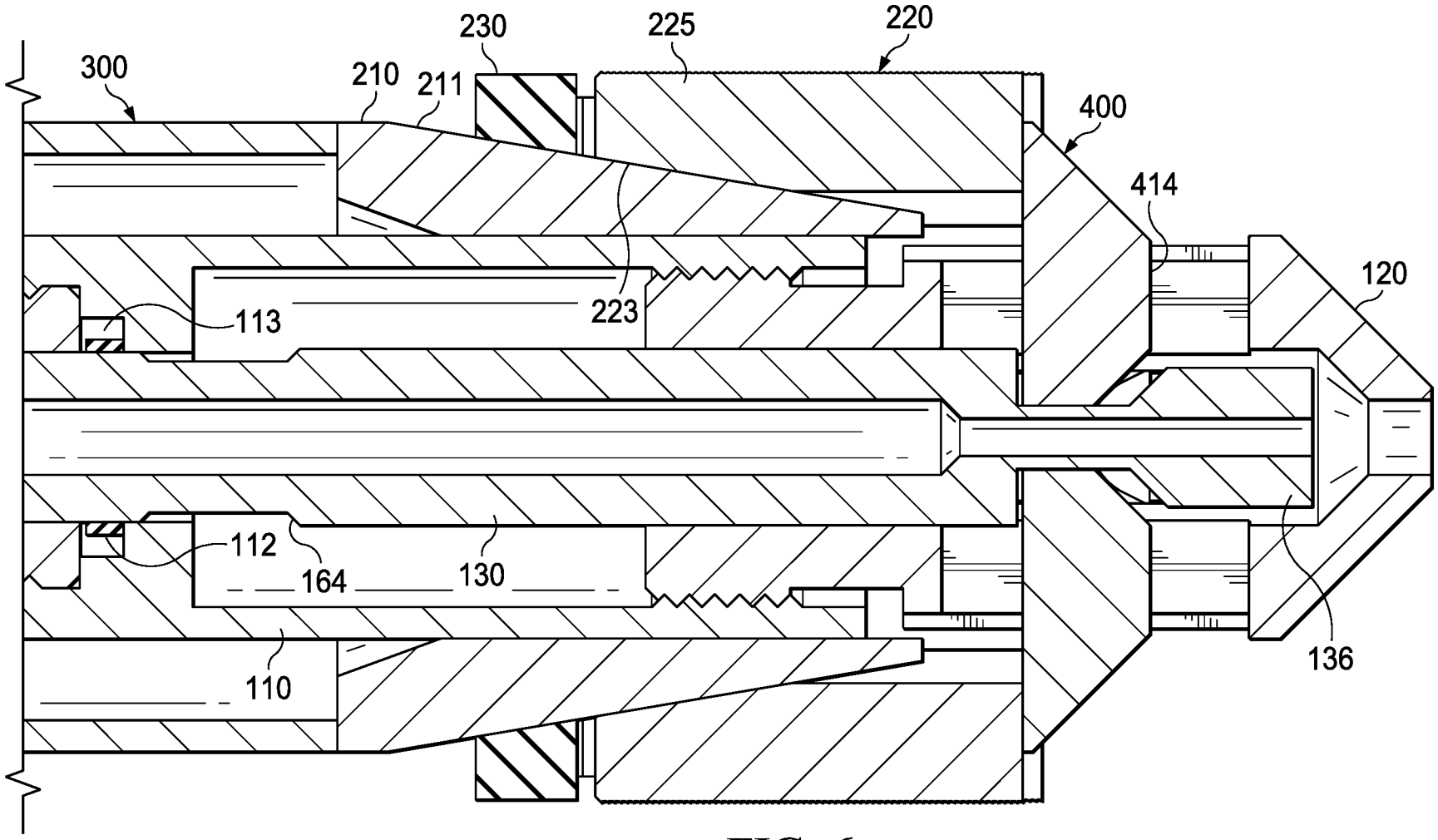
FIG. 6 is a cross-sectional view of a plug and setting adapter assembly, wherein the plug is in the set position.
Figure 8:
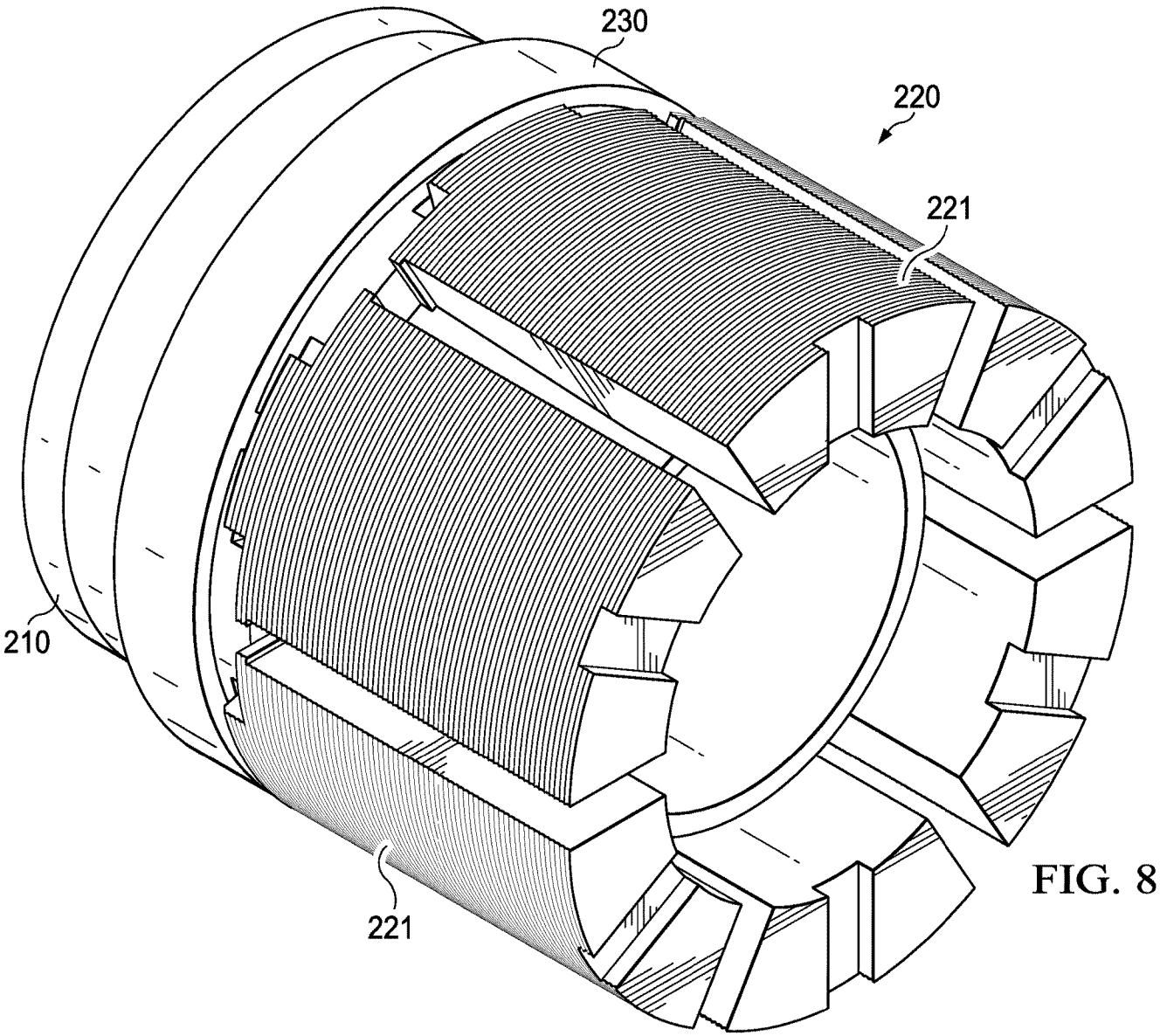
FIG. 8 is a perspective view of a plug in a set position.
Figure 9:
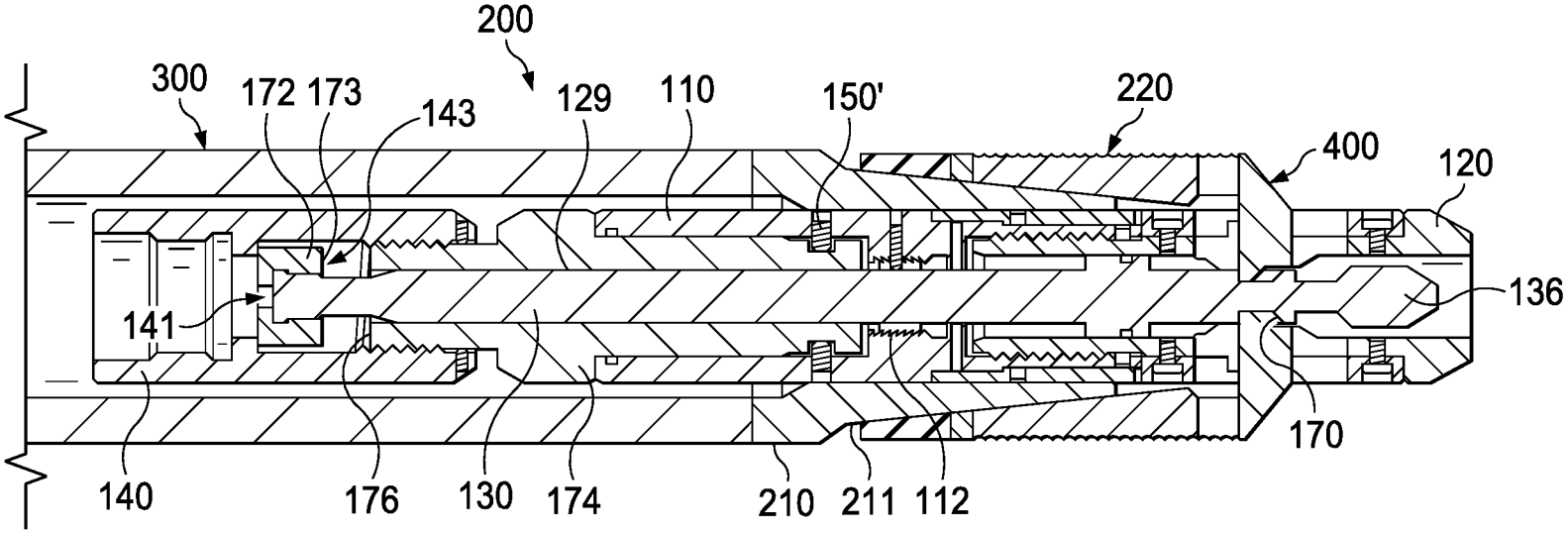
FIG. 9 is a cross-sectional view of the plug coupled to another embodiment of a setting adapter assembly in the first position or "Run-in-Hole" position.
Figure 10:
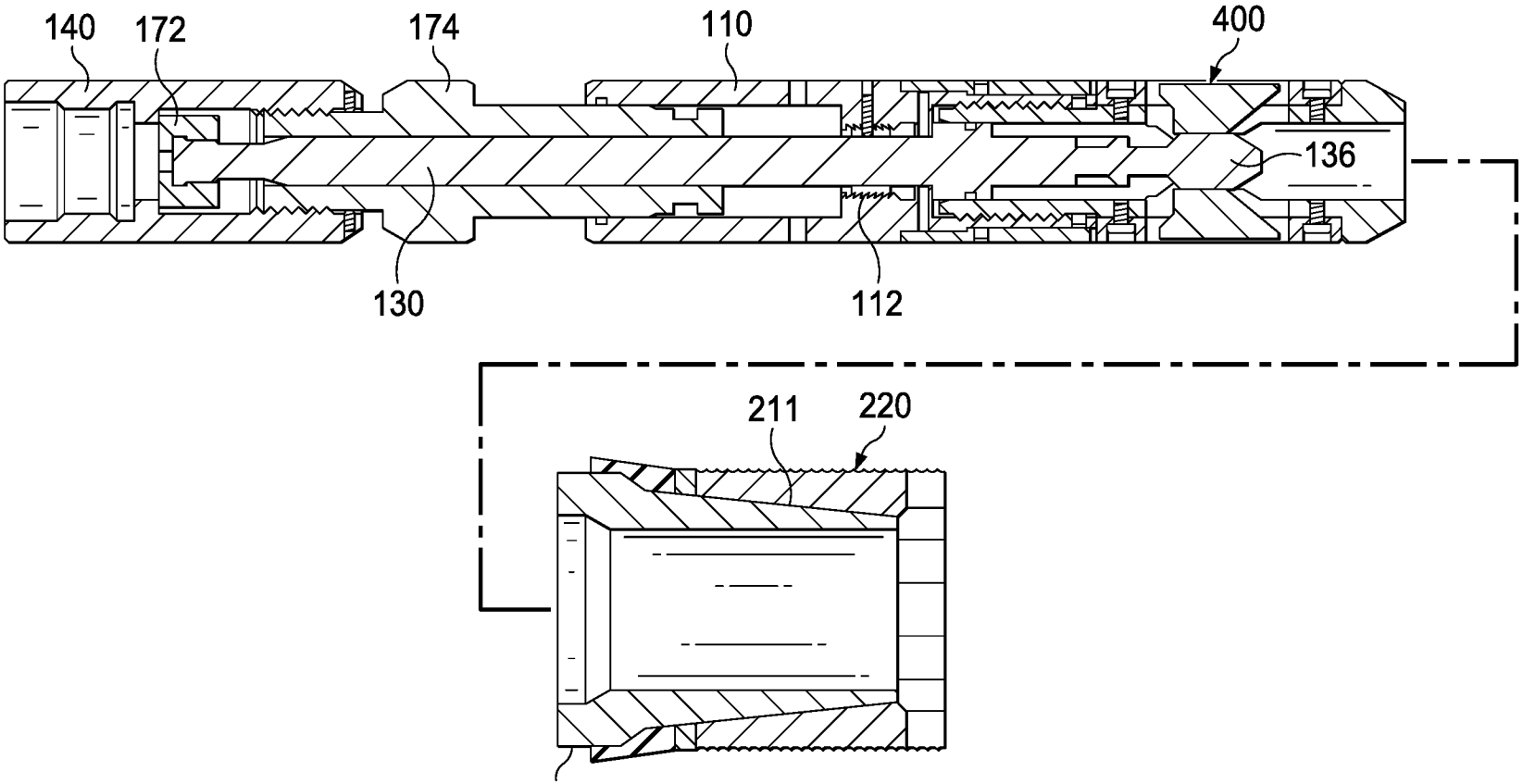
FIG. 10 is a cross-sectional view of the plug and the setting adapter assembly in the second position with the setting adapter extracted from the plug.

Referring to FIG. 6, at the desired position, the processes of setting the plug 200 and withdraw the adapter assembly 100 are divided into several stages according to different setting forces applied to the plug 200. In the first stage, the setting tool urges the setting sleeve 300 to push the plug body 210 of the plug 200 downwardly with a first force while keeping the crossover sub 140 of the setting adapter assembly 100 staying still. The plug slip 220 bears stress and translates the push force to the setting tabs 410 of the rotating dogs 400. The push force on the setting tab 410 can produce torque to make the setting tab 410 rotate clockwise around the pivot pin 420, but the top surface of the pocket 134 stays still and produce torque to counteract the torque produced by the push force, therefore, the setting tabs 410 is against the plug slip 220 and keeps staying still. At the same time, the first setting force exerting on the plug 200 produces a tensile force on the shear ring 150. The first setting force is smaller than the force required to shear the shear ring 150. In this case, the setting sleeve 300 urges the plug body 210 to break the slip 220 into separable slip segments 221 at their predetermined break points and expand outwardly until the segments 221 have securely gripped the walls of the casing or wellbore wall with their ridges 225. And further, the setting sleeve 300 continues to urge the plug body 210 to compress the plug seal 230 against the slip 220 and radially expand the plug seal 230 to form a seal between the plug body 210 and the casing wall in a wellbore, Thus the plug is set. FIG. 8 shows the state of the plug in a set position.

In the second stage, the setting tool urges the setting sleeve 300 to push the plug body 210 of the plug 200 downwardly with a second force which is larger than the first force. Under the circumstances that the setting tabs 410 keeps staying still, the second force is translated to the setting body 110 through the rotating dog carrier 120. Which will produce a tensile force on the shear ring 150. The second force produce enough tensile to shear the shear ring 150 such that the shear ring 150 is broken at the position between the crossover sub 140 and the setting body 110.

Figure 7:
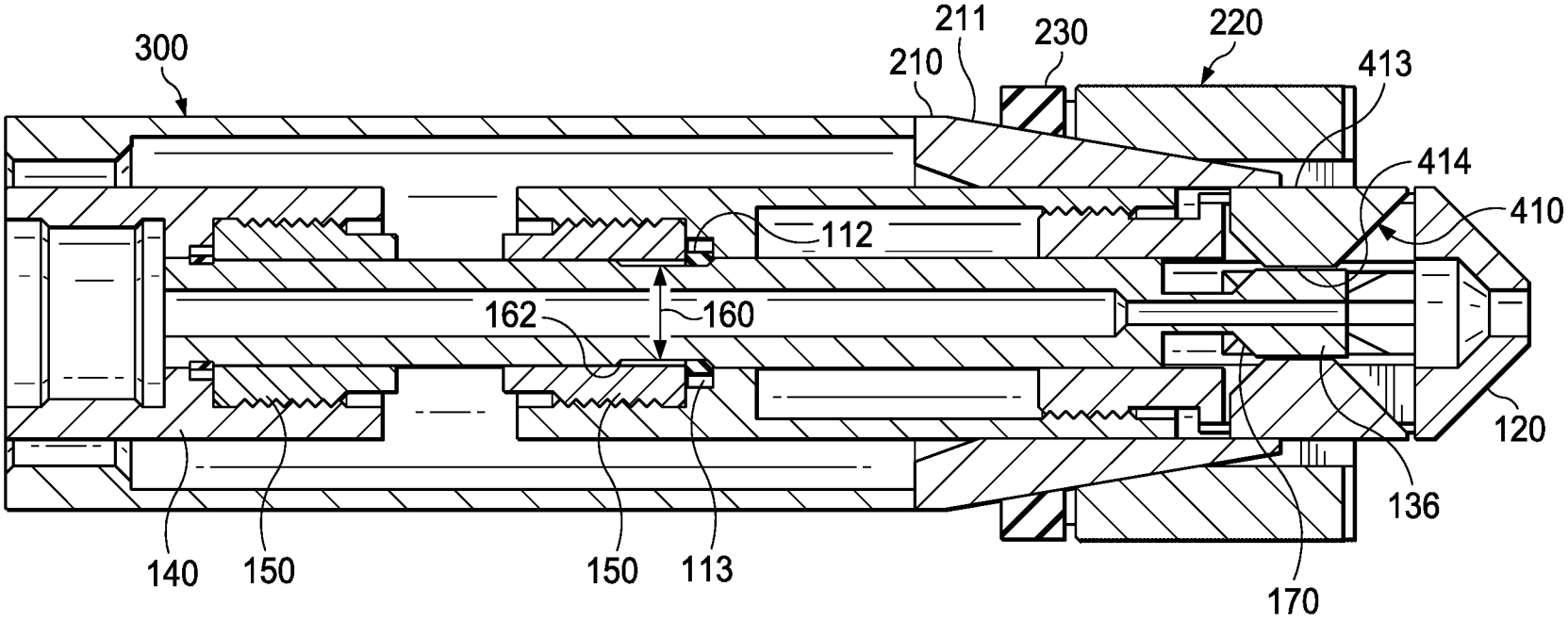
FIG. 7 is a cross-sectional view of a plug and setting adapter assembly, wherein the rotating dogs are in horizontal position.

After the second stage, referring to FIG. 7. pulling upward the setting tool, the crossover sub 140 will pull the inner mandrel 130 upward. In this stage, the bottom end 136 of the inner mandrel 130 moves upward and drive the setting tab 410 rotate around the pivot pin 420 clockwise, this allows the setting tab 410 to rotate 90 degrees into their horizontal position within the dog carrier sub 123. In this case, the parallel plane 413 is flush with the outer side surface of the rotating dog carrier 120 and the parallel plane 414 is flush with the inter side surface of the rotating dog carrier 120. The rotating dog carrier 120 can be freely pulled through the plug 200.

In order to locking the rotating dogs 400 into their horizontal position during the process of withdrawing the adapter assembly 100, the bottom end 136 of the inner mandrel 130 will be keep in the rotating dog carrier 120 and the outer circumference of the bottom end 136 will abuts on the parallel plane 414 to keep the rotating dogs 400 into their horizontal position. To ensure the bottom end 136 be keep in the rotating dog carrier 120, the adapter assembly 100 provide a travel restriction mechanism to limit the distance that the inner mandrel 130 can move in the setting body 110.

Referring to FIG. 2, the travel restriction mechanism includes a locking ring 112 and a circumferential groove 114. The locking ring 112 is located between the inner mandrel 130 and the setting body 110, and can be embedded in a slot 113 in the inner surface of the setting body 110. The slot 113 can be located adjacent the bottom end of the shear ring 150. The circumferential groove 114 is a groove on the surface of the inner mandrel 130 with a certain length. The inner radius of the locking ring 112 is less than the radius of the inner mandrel 130 and cannot round the inner mandrel 130, but it can round the circumferential groove 114 and slide on the circumferential groove 114. In the initial state when the rotating dogs 400 are initially in their vertical positions, the locking ring 112 is on the upper end of the circumferential groove 114. After the plug is set, and the shear ring 150 is sheared, the circumferential groove 114 will move upward following with the inner mandrel 130, at this moment, the setting body 110 will not move and the locking ring 112 stays still, thus the locking ring 112 is on the bottom end of the circumferential groove 114, when continuing to pull the inner mandrel 130 upward, the shoulder of the locking ring 112 will against the bottom surface of the circumferential groove 114 to prevent the relative motion between the inner mandrel 130 and the setting body 110. In this case, the inner mandrel 130 will pull the whole setting adapter assembly upward. The length of the circumferential groove 114 is configured to allow the inner mandrel 130 to move from initial position to the position that the bottom end 136 will abuts on the parallel plane 414 to keep the rotating dogs 400 into their horizontal position.

All of the compositions and methods disclosed and claimed herein can be made and executed without undue experimentation in light of the present disclosure. While the compositions and methods of this disclosure have been described in terms of preferred embodiments, it will be apparent to those of skill in the art that variations may be applied to the compositions and methods and in the steps or in the sequence of steps of the methods described herein without departing from the concept, spirit and scope of the disclosure. All such similar substitutes and modifications apparent to those skilled in the art are deemed to be within the spirit, scope and concept of the disclosure as defined by the appended claims.

What is claimed is:

1. A setting adapter assembly for setting a plug, comprising:

a setting body;

a crossover sub;

a shear ring connecting the setting body and the crossover sub temporarily;

a rotating dog carrier at a lower end of the setting body;

a plurality of rotating dogs accommodated in the rotating dog carrier;

an inner mandrel fixedly connecting with the crossover sub and extending through the shear ring, and the setting body, and extending into an inner chamber of the rotating dog carrier:

wherein the rotating dogs are initially arranged at a bottom of the plug and in a vertical position are arranged to compress the plug during a process of setting the plug, and during a process of withdrawing the setting adapter assembly, the rotating dogs rotate 90 degrees into a horizontal position triggered by movement of the inner mandrel to allow the setting adapter assembly to pass through the plug.

2. The setting adapter assembly of claim 1, wherein the rotating dog carrier comprises a plurality of dog carrier subs to accommodate corresponding rotating dogs.

3. The setting adapter assembly of claim 2, wherein each of the rotating dogs comprises a setting tab and a pivot pin.

4. The setting adapter assembly of claim 3, wherein the dog carrier subs comprises slots to accommodate the pivot pins.

5. The setting adapter assembly of claim 4, wherein the inner mandrel comprises a pocket to accommodate a portion of the setting tabs when the rotating dogs are in their vertical position.

6. The setting adapter assembly of claim 5, wherein the setting tab comprises a ramped face, the inner mandrel comprising a bottom end being adjacent the pocket, the bottom end comprising a ramped leading edge face for engaging a ramped face of the setting tab.

7. The setting adapter assembly of claim 6, further comprising: a travel restriction mechanism to limit the distance that the inner mandrel can move in the setting body.

8. The setting adapter assembly of claim 7, wherein the travel restriction mechanism comprises a locking ring and a circumferential groove.

9. The setting adapter assembly of claim 8, wherein the locking ring is embedded in a slot in the inner surface of the setting body and is located adjacent a bottom end of the shear ring.

10. The setting adapter assembly of claim 8, wherein the length of the circumferential groove is configured to allow the inner mandrel to move from an initial position to a position where the bottom end of the inner mandrel abuts the setting tabs to keep the rotating dogs in their horizontal position.

11. A method of setting a plug using a setting adapter assembly, comprising the steps of:

arranging the setting adapter assembly between the plug and a setting tool; the setting adapter assembly comprising:

a setting body;

a crossover sub;

a shear ring connecting the setting body and the crossover sub temporarily;

a rotating dog carrier at a lower end of the setting body;

a plurality of rotating dogs accommodated in the rotating dog carrier;

an inner mandrel fixedly connecting with the crossover sub and extending through the shear ring, and the setting body, and extending into an inner chamber of the rotating dog carrier:

wherein the rotating dogs are initially arranged at a bottom of the plug and in a vertical position are arranged to compress the plug during a process of setting the plug, and wherein during a process of withdrawing the setting adapter assembly, the rotating dogs rotate 90 degrees into a horizontal position triggered by movement of the inner mandrel to allow the setting adapter assembly to pass through the plug;

running the setting tool loaded with the plug and the setting adapter assembly downhole to a desired location;

pushing a plug body of the plug downwardly with a first force while keeping the crossover sub staying still to set the plug;

pushing the plug body of the plug downwardly with a second force to shear the shear ring;

withdrawing the setting adapter assembly through the plug.

* * * * *